US006301767B1

(12) United States Patent
Granger et al.

(10) Patent No.: US 6,301,767 B1
(45) Date of Patent: Oct. 16, 2001

(54) CAP WITH PLASTIC SLEEVE

(75) Inventors: Jacques Granger, Libourne; Richard Poyol, Menesterol, both of (FR)

(73) Assignee: Pechiney Emballage Alimentaire, Clichy (FR)

( * ) Notice: Subject to any disclaimer, the term of this patent is extended or adjusted under 35 U.S.C. 154(b) by 0 days.

(21) Appl. No.: 09/402,490

(22) PCT Filed: Apr. 17, 1998

(86) PCT No.: PCT/FR98/00783

§ 371 Date: Oct. 15, 1999

§ 102(e) Date: Oct. 15, 1999

(87) PCT Pub. No.: WO98/47785

PCT Pub. Date: Oct. 29, 1998

(30) Foreign Application Priority Data

Apr. 21, 1997 (FR) ..... 97 05182

(51) Int. Cl.[7] ..... B21D 35/00
(52) U.S. Cl. ..... 29/469.5
(58) Field of Search ..... 215/254, 352; 426/122; 29/17.2, 469.5

(56) References Cited

U.S. PATENT DOCUMENTS 1,043,359 * 11/1912 Revel, Jr. .
3,130,056 * 4/1964 Taylor et al. .
3,647,617 * 3/1972 Rieke et al. .
3,923,198 * 12/1975 Brochman ..... 220/359
3,931,904 * 1/1976 Coop ..... 215/254
4,605,137 * 8/1986 Taragna et al. ..... 215/254
4,605,138 * 8/1986 Taragna et al. ..... 215/254
4,813,557 * 3/1989 Herron et al. ..... 215/329
5,103,989 * 4/1992 Druesne et al. ..... 215/254
5,222,616 * 6/1993 Druesne et al. ..... 215/256

FOREIGN PATENT DOCUMENTS 0475856 2/1992 (EP) .

* cited by examiner

*Primary Examiner*—Allan N. Shoap
*Assistant Examiner*—Joseph C. Merek
(74) *Attorney, Agent, or Firm*—Dennison, Scheiner, Schultz & Wakeman

(57) ABSTRACT

An overcap for a container including a head portion and a skirt portion, and a method for its production. The skirt portion has a metal wall and an opening area constructed and arranged to be broken during removal of the overcap. A sleeve of plastic material adheres to the metal wall over an area limited to the opening area.

13 Claims, 4 Drawing Sheets

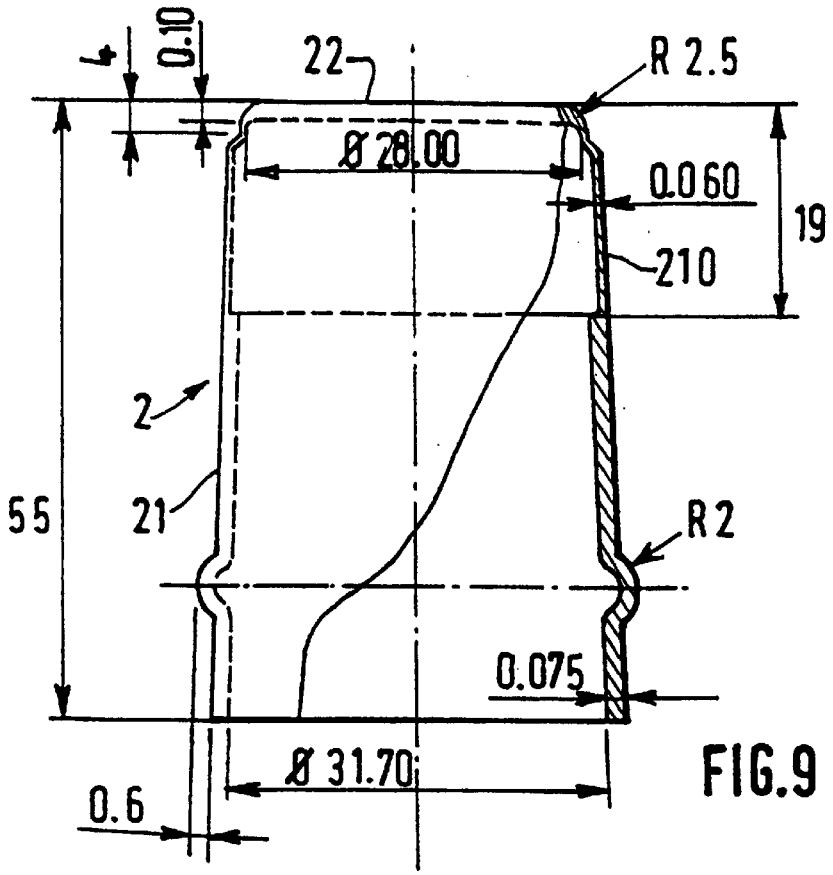
FIG.9
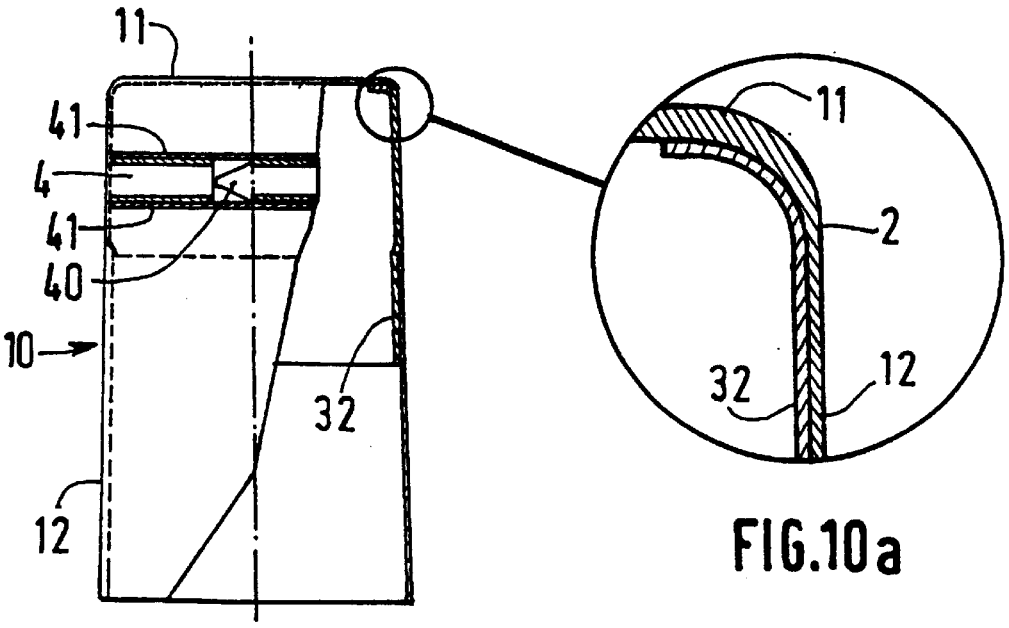
FIG.10a
FIG.10

CAP WITH PLASTIC SLEEVE

FIELD OF THE INVENTION

The invention relates to the field of caps, and more particularly to that of metal caps and over caps. Over caps, applied to the necks of containers fitted with a stopper, are intended, apart from their decorative effect, notably to guarantee that the containers are impregnable. These over caps are possibly fitted with means for easy first opening (score lines, detachable tabs, etc.. ), but if not, the head of the cap is cut off with a knife so that the container can then be opened.

DESCRIPTION OF RELATED ART

Numerous metal over caps are already known, notably those described in the patents below, in the name of the applicant :

- in European Patent EP-B1-363 285, an over cap made of aluminum is described that is easily cut away and which has a peripheral ring or rib, so that a blade used to cut the cap when it is first opened is guided.
- in French patent FR-B1-2 636 257, a metal cap is described that has a non-cutting tear line provided by a succession of transverse reliefs and hollows.
- similarly in French patent FR-B1-2 657 031 an aluminum cap is described with a non-cutting tear line obtained through a succession of alternating reliefs and hollows.
- finally in French patent FR-B1-2 665 887, an over cap is described that can be cut without risk of injury. This cap is made from a multi-layer material made up of two layers of aluminum connected to one another by an adhesive layer with a Shore hardness less than 80.

There is an ever increasing level of user safety demanded of manufactured products. This is also the case for metal caps and over caps even though, when cut in the correct manner, they pose very little risk of injuring the consumer through a cut caused by the metal edge formed when the cap is first opened. Nevertheless, it is advisable that manufactured products take account of the dangers that can be increased in the case of a consumer who cuts the cap in a thoughtless or absent-minded way.

Already in the past, as mentioned in the state of the technology, various attempts have been made to resolve this problem. In the case of over caps not equipped with means for first easy opening, it is known from French patent FR-B1-2 665 887 that an over cap made from a multi-layer material made up of two layers of aluminum connected to one another by an adhesive layer with a Shore hardness less than 80 can be cut without any risk of injury. This solution to the problem has not been developed commercially because of the significantly higher cost of manufacture, bearing in mind the initial cost of the M/P/M type of multi-layer material, where M designates a metal layer of aluminum and P designates a layer of adhesive material.

The problem to be resolved is, on the one hand to provide caps which do not cut after being cut with a knife and which, at the same time, have a cost price which is not very high. In addition, it is important that these caps resemble in their feel, their malleability and in their sonority when they come into contact with other objects, caps made of tin-lead, now in general forbidden by national legislation but which have that "top of the range" image that is always looked for by the consumer.

Finally, the applicant has sought to produce a cap which can possibly be equipped with easy opening means, during the first opening by the consumer in such a way that a single manufacturing line can, according to choice, lead to caps that can be opened either by cutting with a knife or by pulling, typically on a tab or tear strip.

SUMMARY OF THE INVENTION

According to the invention, the metal cap or over cap for a container has a head and a skirt comprising a metal side wall, and has an opening area intended to be broken when the cap is first opened, is characterized in that said cap comprises a sleeve made of a plastic material that adheres to said metal side wall in the part of the cap corresponding to said opening area.

The applicant was surprised to observe that the solution proposed allowed one to simultaneously resolve the entire group of problems posed, namely to reduce the risk of injury, improve the "feel" of the caps or to allow the addition of means for first easy opening.

Generally said opening area includes the upper part of the skirt—that part close to said head—generally situated at the level of the collar of glass in the case where the container is a bottle. However, it can also include the end of said skirt, up to the angle formed by the skirt and the head, insofar as certain consumers simply cut the head of the cap with a knife. Consequently, according to the invention, said skirt is covered by said sleeve over a height at least corresponding to that of said opening area.

BRIEF DESCRIPTION OF THE DRAWINGS

FIGS. 2*a* to 4*c* represent caps (10) according to the invention in axial half section.

In FIGS. 2*a* and 2*b*, the sleeve (31, 32) is on the inside of said blank (2). In FIG. 2*a*, said sleeve (31) covers the skirt (21) over its entire height, while in FIG. 2*b*, said sleeve (32) only covers the skirt (21) over the opening area.

In FIG. 3*a*, said sleeve (33) covers the skirt (21) over its entire height, while in FIG. 3*b*, said sleeve (34) only covers the skirt (21) over the opening area.

In FIG. 4*c*, in an analogous way to FIG. 2*a*, a cap (10) has been shown that has both a circular tear strip (4) and a vertical tear strip (5) extending from the bottom of the skirt (21) to the height of said circular tear strip (4).

FIG. 5 shows a mandrel (6) comprising a central flaring core with a substantially truncated conical end (62) onto which can slide an expandable ring made of a metal with a spring effect and having a truncated conical internal wall and a substantially cylindrical external wall. In the high position, as shown in FIG. 5, said expandable ring (61) is lined with a cylindrical ring (60) made of elastomer.

FIG. 5 corresponds to the first step of the method a portion of tube (3) intended to form said sleeve (31, 32) is positioned over said cylindrical ring made of elastomer (60), its top edge projecting a few millimeters.

In FIG. 6, a sleeve (30) with a folded over top edge (300) is formed on said mandrel (6) by applying hot air (7).

In FIG. 7, the cap blank (2) is put into position.

In FIG. 8, the heated die 8 is actuated in a reciprocating motion which brings about:

Figure 1:
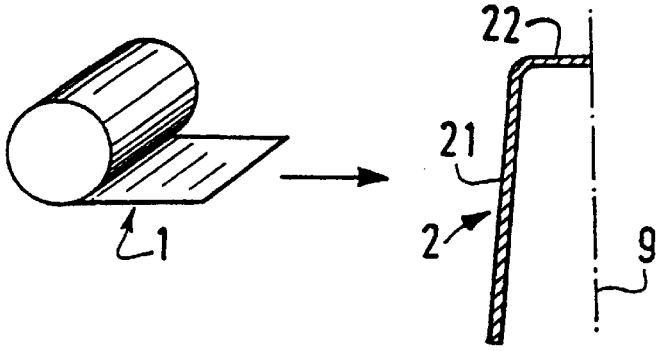
FIG. 1 diagrammatically shows the formation of a cap blank (2) from a material on a roll (1) which can be a strip of aluminum or a multi-layer material including a layer of aluminum. Said blank (2), which can be shaped by any known method, typically by stamping and drawing, by sticking, has a skirt (21) and a head (22). Said blank (2) is represented in axial half-section, the axis (9) being a cylindrical axis of symmetry. The same representation has been used for FIGS. 2*a* to 4*c*.
Figure 2A:
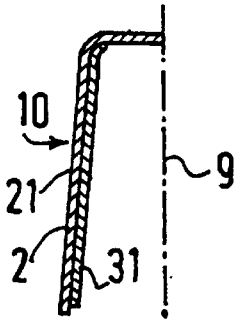
Figure 2B:
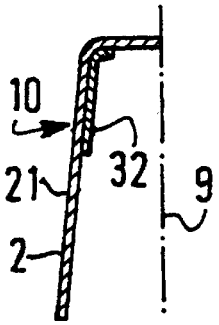

separation from the cylindrical ring made of elastomer (60) and the placing of the sleeve (30) against the corresponding internal surface of said blank (2), the transfer of calories through said blank (2) that are necessary and sufficient to heatseal said sleeve (30) to said blank (2) and to thereby form a cap (10) comprising a cap blank (2) lined on the inside with a sleeve (32).

FIG. 9 is an axial section view of a cap blank (2) used for the tests. It has a skirt (21) the opening area (210) of which at its top part has been thinned down.

FIG. 10 is a mixed view (a section view on the right hand side—a front elevation on the left) of a cap (10) made up of a head (11) and a skirt (12), obtained from the blank (2) in FIG. 9, lined on the inside with a sleeve (32) over the top half of its skirt.

FIG. 10*a* is an enlarged section view of the area where the head (11) and skirt (12) join.

Figure 11:
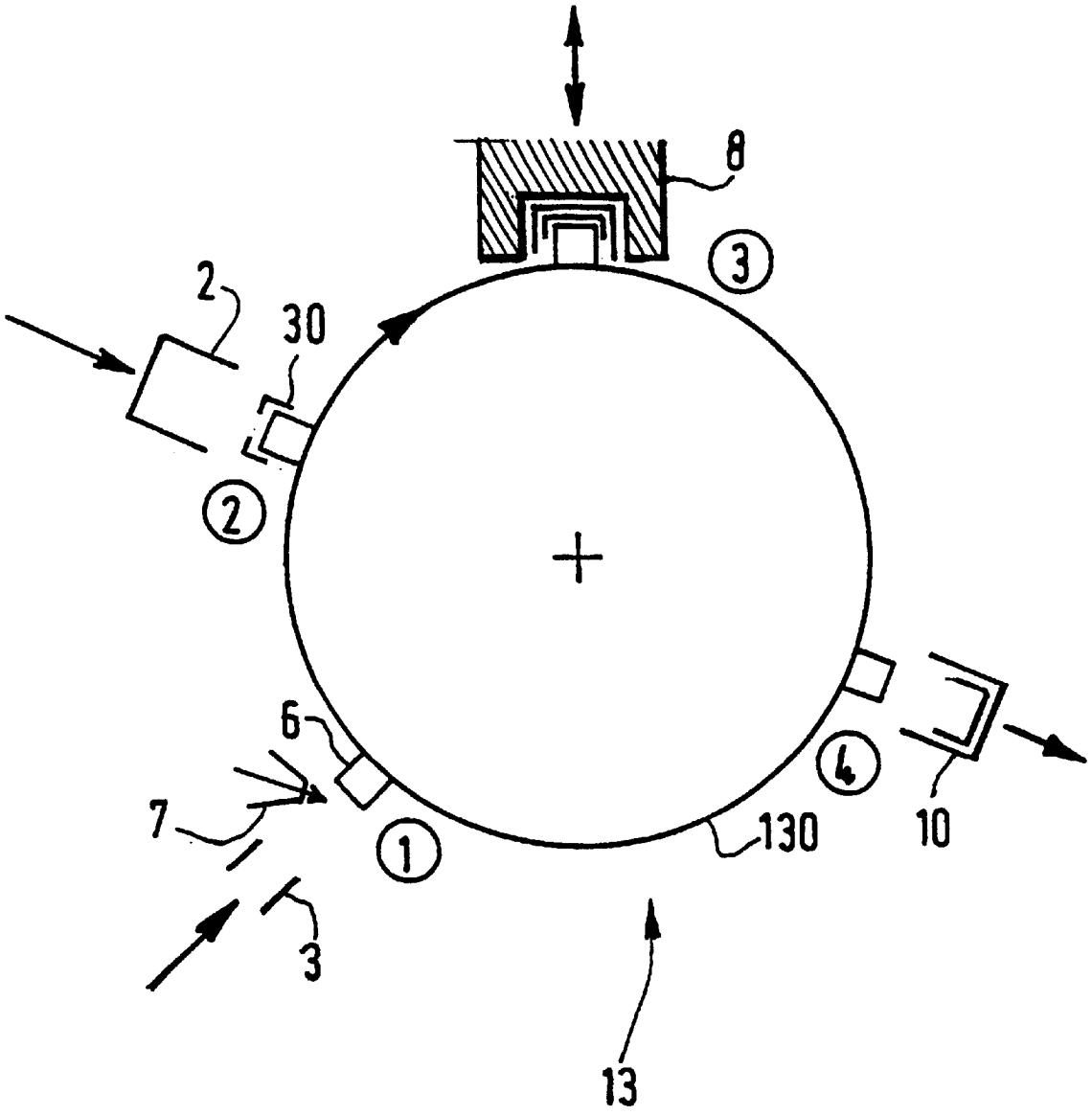

FIG. 11 is a diagrammatic view of the device (13) for the industrial implementation of the method according to the invention in the case of an internal sleeve. This device comprises a rotating drum (130) typically with 4 mandrels (6) and 4 stations marked 1 to 4. At station 1, the portion of tube (3) is supplied and positioned over the mandrel (6) and then a sleeve is formed by blowing hot air (7). At station 2, the cap blank is positioned over the sleeve (30).

At station 3, the heated die (8) is applied at a specified temperature and pressure and for a specified time. At station 4, the formed cap (10) is ejected. The device (13) can include other additional stations.

DESCRIPTION OF THE PREFERRED EMBODIMENTS INVENTION

The cap (10) according to the invention is made up of a cap blank (2) and a sleeve (30)—only this reference number will be used when referring to a sleeve considered in a generic way, otherwise other reference numbers (31, 32, 33, 34) will be used for specific sleeves. Said cap blank (2) constitutes said metal wall. Said metal wall encompasses both the case of a metal wall in the strict sense and a metal-plastic wall according to whether the starting material (1) is a metal strip or sheet, typically made of aluminum or a multi-layer material comprising a metal layer and at least one layer of plastic material. According to the invention, said sleeve (30) can be either on the inside or on the outside of said skirt—the words "inside" and "outside" being used in relation to the metal wall of the cap blank (2). In effect, the functions of the sleeve and the results obtained are not connected to this positioning criterion. Preferably, said sleeve (30) is inside said skirt.

The thickness of said sleeve (30) is between 0.3 times and 3 times the thickness of said metal wall of said opening area. In effect, in order for the problems to be resolved according to the invention, said sleeve must have sufficient thickness, at least equal to 0.3 times the thickness of said metal wall. In addition, if the sleeve is too thick, more than 3 times the thickness of said metal wall, it would no longer be of use to resolve the problems posed.

Preferably, the thickness of said sleeve is between 0.6 and 1.7 times the thickness of said metal wall.

Preferably, said metal wall comprises a layer of aluminum or aluminum alloy, preferably lightly alloyed (typically from the 1000 series), in the annealed condition, and of a mean thickness between 30 and 100 $\mu$m, and can possibly include a layer of plastic material of mean thickness between 20 and 100 $\mu$m when the starting material (1) is a metal-plastic material. Whichever case, either a metal wall in the strict sense or a metal-plastic wall, the mean thickness of said metal wall is preferably between 50 and 80 $\mu$m so that the cap can be crimped without forming creases.

According to the invention, said plastic material for said sleeve (30) is chosen from among films of thermo-plastic material or lacquers including a thermo-plastic material or cellular lacquers which may or may not be charged with a porogenic agent. Said film of thermoplastic material which can be a single layer or multi-layered material, can include a layer that can be cold sealed or hot sealed to said skirt (21). Said heatsealable layer includes a polyolefin polymer or copolymer that has acid groups either in free form or as salts (for example ionomeric resins), that provide adherence to a metal wall, notably an aluminum or aluminum alloy wall.

By way of examples, one could mention Surlyn® films, co-extruded EAA/PE (LDPE) films, co-extruded Morprime®/PP films, OREVAC©/PE or PP films etc.

According to another embodiment of the invention, said film of plastic material for said sleeve can be made to adhere to said skirt by means of a layer of adhesive, which is deposited at the time said sleeve (30) and said blank (2) are assembled.

According to another embodiment of the invention, said sleeve can also be obtained by direct injection or die stamping of plastic material to the inside or outside of said blank.

It can be advantageous to use said sleeve for various purposes. Hence said plastic material of said sleeve (30) can include at least one of the following elements: a) coloring in the mass of said plastic material, b) printing on the surface or possibly between the layers in the case of a multi-layer film, c) incorporation into said plastic material of identifying additives that constitute a way of combating theft, fraud or counterfeiting, d) a supplementary external layer that permits adherence to the neck of said receptacle in such a way as to prevent any fraudulent removal of said cap without it being destroyed.

In contrast to caps according to the state of the art that correspond to cap blanks (2) and do not therefore include a sleeve, the caps according to the invention can include means intended to facilitate the first opening (4, 40, 41, 5, 50, 51), as illustrated in FIGS. 4*a*, 4*b*, 4*c* and 10.

In effect, the caps corresponding to the blanks (2), for example as illustrated in FIG. 9 should have a wall that is thinned down in the opening area (210) for the purpose of opening it using a knife to cut it off. The applicant has observed that this same cap would no longer be able to be fitted with a tear strip—unless it was a very broad strip which would not be very attractive. In effect, taking into account the small thickness of metal in the opening area, the tear strip would have a tendency to break off before it had been pulled away over its whole circumference.

The caps according to the invention can therefore either be used both with a view to opening them with a knife but with less risk of injury, or can be fitted with means intended to facilitate the first opening, and this without any need to modify the specifications of the cap, in particular the thickness of the metal wall.

Another subject of the invention is the method of manufacturing a cap according to the invention.

In the method according to the invention, a) firstly a blank (2) of said metal cap (10) is formed by a series of steps of shaping a strip (1) or a sheet comprising a metal layer, typically by stamping and drawing in such a way that said blank has at least 50% of the final height of said cap, b) said blank (2) is then lined with said sleeve (30), previously shaped, by causing said sleeve (30) to adhere to said blank (2), c) if it is not complete at the end of step a) one then proceeds to shape said blank (2) and to perfect it notably by forming means (4, 40, 41, 5, 50, 51) intended to facilitate its first opening.

In this method, at step a), one can carry out all treatments which are liable to damage said sleeve (30), notably heat treatments, including operations such as cap decoration that may require heat treatments that would be carried out at a temperature greater than the melting point of said sleeve. It is possible to use step b) in which said blank (2) is lined with said sleeve (30) to provide all or part of said shaping or said finishing of step c), for example in order to form a relief on the head (11) of the cap (10) or to deposit a excise stamp. According to a preferred embodiment, said sleeve (30) is arranged inside said cap. In this case, said sleeve (30) is preferably made up of a plastic film which is applied to the inside of said blank (2):

by placing said sleeve (3) on a mandrel (6), then by placing said blank (2) on said sleeve (30), possibly shaped, using a heated die (8) to exert a pressure and carry out a transfer of heat from said die (8) to said blank (2) and then to said sleeve (30) for a time and at temperature chosen in a way that ensures adherence of said sleeve (30) to said blank (2) without any melting of the sleeve (30) at the interface between it and said mandrel (6).

This method is illustrated in FIGS. 5 to 8.

Figure 5:
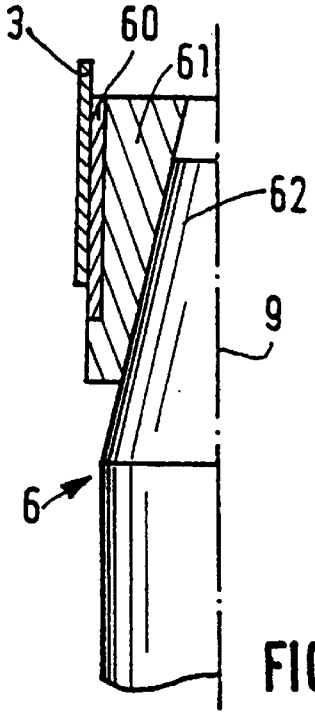
FIGS. 5 to 8 are axial half-sections of an example of a device intended to internally line said blank (2) with said sleeve (31, 32) illustrating the steps of the corresponding method.
Figure 6:
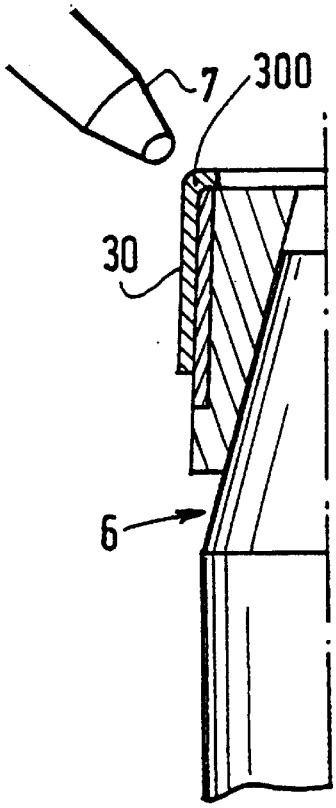
Figure 7:
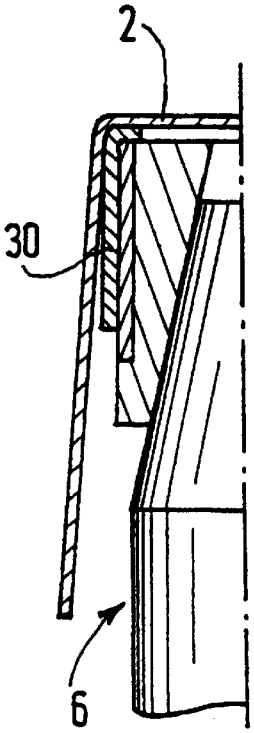
Figure 8:
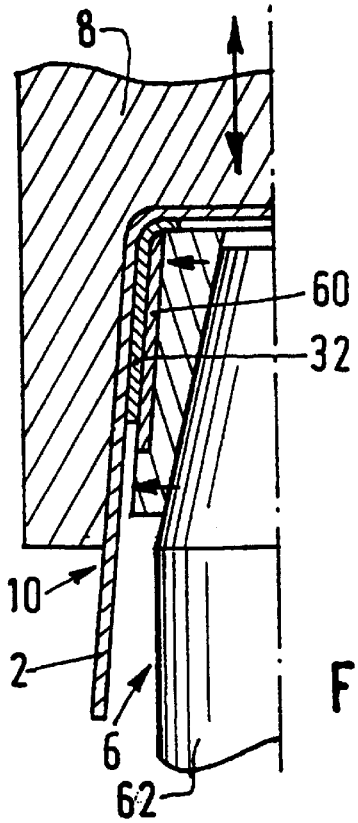

The applicant has found it to be particularly advantageous according to the invention to form said sleeve (30) on said mandrel (6) by a simple blowing of hot air, as illustrated in FIGS. 5 and 6, by choosing to form said sleeve (30), a tubular film obtained by blow molding, in such a way that, taking into account the memory effect of the film, the end of the portion of tube (3) is automatically folded over the head of the mandrel (6) under the action of the heat.

It is advantageous that said mandrel (6) comprises a means (61, 62) that permits its radial expansion, in a way that applies said sleeve (30) against said blank (2) with a pressure sufficient to ensure adherence of said sleeve to said blank. A specific embodiment of such a mandrel (6) is described in FIGS. 5 to 8.

On the one hand, with respect to the conditions of pressure, temperature and time that ensure adherence of said sleeve, it is advisable to have a time-temperature combination such that there is softening of said sleeve or fusion at the interface between said sleeve (30) and said blank (2) and this is without there being any fusion between said sleeve (30) and said mandrel (6) at the interface between them. Typically the heated die is at 200–300° C., preferably between 200 and 260° and it is applied for a time of between 0.1 and 1.5 seconds, preferably for 0.5 to 0.9 seconds.

On the other hand, with respect to the pressure exerted on said sleeve against said blank (2), preferably it must be at least equal to 0.1 daN/mm$^2$ and more preferably at least equal to 0.15 daN/mm$^2$.

Figure 3A:
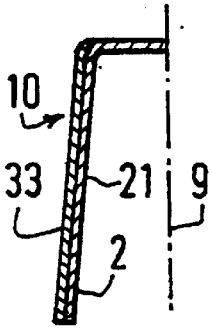
In FIGS. 3*a* and 3*b*, the sleeve (33, 34) is on the outside of said blank (2).
Figure 3B:
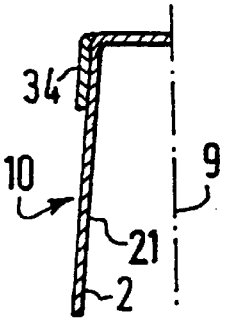
Figure 4A:
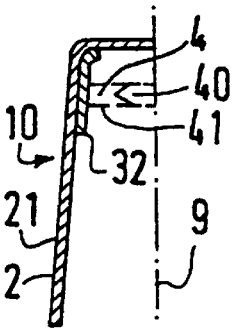
In FIG. 4*a*, in an analogous way to FIG. 2*b*, a cap (10) has been shown that has a circular tear strip (4) with its opening tab (40), formed between two score lines (41).
Figure 4B:
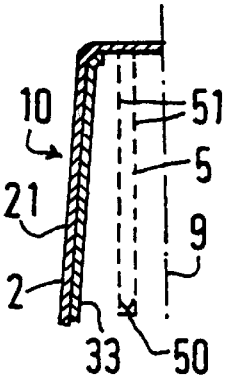
In FIG. 4*b*, in an analogous way to FIG. 2*a*, a cap (10) has been shown that has a vertical tear strip (5) with its opening tab (50), formed between two score lines (51). The tear strip extends over the entire height of the skirt (21).
Figure 4C:
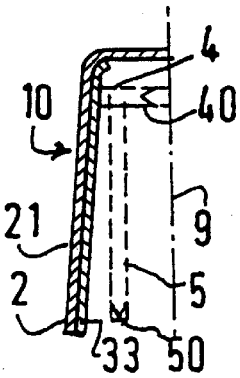
Figure 4D:
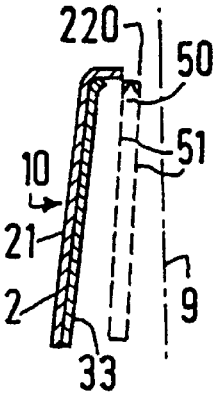
In FIG. 4*d*, by way of example, a cap analogous to that in FIG. 4*b* is shown but one in which the head of the cap is open (220), which allows the opening tab (50) to be positioned at the level of the head (22).

One can also, according to the invention, apply said sleeve (30) to the outside of said blank, as illustrated in FIGS. 3*a* and 3*b*, and in this case, said sleeve (33, 34) is preferably a heat shrinkable film which is applied to the outside of said blank (2).

Another subject of the invention is the device to implement the method according to the invention in the case where said sleeve (30) is applied to the inside of said blank. This device is illustrated in FIGS. 5 to 8 and 11. It includes a mandrel (6) and a heated die (8), said mandrel including a ring that can be expanded radially following axial compression between said mandrel (6) and said die (8) in a way that applies said sleeve (30) against said mandrel (2).

With the device illustrated in FIGS. 5 to 8, the axial pressure between die (8) and mandrel (6) is transformed into radial pressure, by the flaring core (62) with the shape of a truncated cone.

EMBODIMENT EXAMPLES

EXAMPLE 1

Blanks (2) were made in a 1000 series aluminum alloy conforming to FIG. 9 by stamping and drawing a strip of aluminum 100 $\mu$m thick.

A roll of EAA/LDPE film, 29 mm diameter and 90 $\mu$m thick, comprising a 30 $\mu$m layer of EAA and a 60 $\mu$m layer of LDPE formed by co-extrusion blow molding in a bubble. The device (13) described in FIG. 11 and in FIGS. 5 to 8 was used with regard to the detail of each step: At station 1, sleeves (30) were formed from the EAA/LDPE film, 28 mm in height having an overlap (300) of 4 mm provided instantaneously by blowing hot air (7). At station 2, the blanks (2) which had their final height, were supplied. At station 3, the heated die (8) was applied at a temperature of 240° C. for 0.8 seconds and with an axial force of 300 daN converted into a radial force (200 daN) over a surface area of sleeve of about 1000 mm$^2$ —being a pressure of about 0.18 daN/mm$^2$. At station 4, the caps according to the invention were ejected. These caps were used for the over-capping of bottles of wine.

EXAMPLE 2

The caps according to the invention, identical to those of Example 1, were manufactured with additionally a tear strip (4) as shown in FIG. 10, since they were more specifically intended for the over-capping of bottles of spirits. This strip had a width of 6 mm.

Comparative Results

The caps from test 1 were compared to blank caps (2). The caps from test 2 were compared with capsules made of Softgard® tin fitted with a similar tear strip. The comparison of the caps was carried out by users in accordance with a specific protocol that included opening 15 bottles fitted with caps which were code named and in the presence of a person responsible for observing in detail all relevant facts.

The result of these tests was that the caps according to the invention were judged both with regard to their ease of opening and their safety of opening or their feel, superior to the reference caps for over-capping wine where the reference product was the blank cap itself, and comparable to the reference caps for over-capping spirits where the reference product was a cap based on tin.

What is claimed is:

1. Method for manufacturing an overcap, comprising the steps of:

a) forming a blank of said overcap from a metal layer and shaping said blank into a head portion and a skirt portion comprising an opening area constructed and arranged to be broken during removal of the overcap;

b) placing a sleeve made of a plastic film on a mandrel;

c) placing said blank on said sleeve on the mandrel;

d) using a heated die to exert pressure and transfer heat from the die to the blank and to the sleeve, at a temperature and for a time sufficient to cause adherence of the sleeve and blank without melting of the sleeve at a sleeve-mandrel interface, said sleeve being adhered to said shaped blank over an area limited to said opening area; and e) optionally further shaping the blank by forming means for facilitating an initial opening.

2. Method according to claim 1, wherein said sleeve has a thickness between 0.3 and 3 times that of the metal wall of said opening area.

3. Method according to claim 2, wherein said metal wall comprises a layer of aluminum or aluminum alloy, in an annealed condition, having a mean thickness of 30 to 100 $\mu$m and optionally comprises a layer of plastic material of mean thickness 20 to 100 $\mu$m.

4. Method according to claim 1, wherein said sleeve comprises a single-layered or multi-layered thermoplastic film, including a layer which is cold sealable or heat sealable to said skirt.

5. Method according to claim 1, wherein said sleeve comprises a thermoplastic film including a layer of adhesive.

6. Method according to claim 4, wherein said sleeve comprises a thermoplastic film which is heat sealable to said skirt, and comprises a polyolefinic polymer or co-polymer having acid groups in free form or in salt form, which provide adherence to a metal wall.

7. Method according to claim 1, wherein said plastic film comprises at least one element selected from the group consisting of coloring in the plastic material, surface printing, printing between layers of material, an identifying additive, and a supplemental external layer permitting adherence to a receptacle and which is adapted to prevent removal of the overcap without destruction thereof.

8. Method according to claim 1, additionally comprising means for facilitating initial opening.

9. Method according to claim 1, wherein the blank is shaped in step a) by stamping and drawing such that the shaped blank has a height of at least 50% of said overcap.

10. Method according to claim 1, wherein step a) further comprises a heat treatment carried out at a temperature above the melting temperature of the sleeve.

11. Method according to claim 1, wherein said adhering step includes said further shaping step.

12. Method according to claim 1, additionally comprising radially expanding said mandrel to force the sleeve against the blank with sufficient pressure to cause adherence of the sleeve to the blank.

13. Method according to claim 1, wherein the sleeve comprises a heat shrinkable film and is applied to an outside surface of the blank.

* * * * *